United States Patent [19]

Farrar

[11] Patent Number: 4,638,582

[45] Date of Patent: Jan. 27, 1987

[54] GRIP FOR HAND GUN

[76] Inventor: Frank W. Farrar, 11941 Paseo Bonita, Los Alamitos, Calif. 90720

[21] Appl. No.: 762,950

[22] Filed: Aug. 6, 1985

[51] Int. Cl.[4] ..... F41C 23/00

[52] U.S. Cl. ..... 42/71.01

[58] Field of Search ..... 42/71 P

[56] References Cited

U.S. PATENT DOCUMENTS

| | | | |
|---|---|---|---|
| 1,049,739 | 1/1913 | Leach, Jr. | 42/71 P |
| 3,683,535 | 8/1972 | Lewis | 42/71 P |
| 4,132,024 | 1/1979 | Pachmayr et al. | 42/71 P |
| 4,148,149 | 4/1979 | Pachmayr et al. | 42/71 P |
| 4,315,379 | 2/1982 | Lang | 42/71 P |
| 4,333,256 | 6/1982 | Hogue | 42/71 P |

*Primary Examiner*—Deborah L. Kyle

*Assistant Examiner*—Ted L. Parr

*Attorney, Agent, or Firm*—Beehler, Pavitt, Siegemund, Jagger, Martella & Dawes

[57] ABSTRACT

A one piece grip for hand guns such as a pistol is made of yieldable elastomeric material having an exterior configuration to be comfortably grasped by the user. Within the grip is a pocket shaped to accommodate the metal tang or frame of the gun handle. At the upper end of the grip is an opening through which the tang is inserted into the pocket. Plugs in the pocket which are spread apart to allow for insertion of the frame in the pocket add to the rigidity of the grip. A releasable fastening bolt may be used to anchor the grip in position on the tang until there may be need for removal and replacement.

11 Claims, 12 Drawing Figures

Fig. 1.
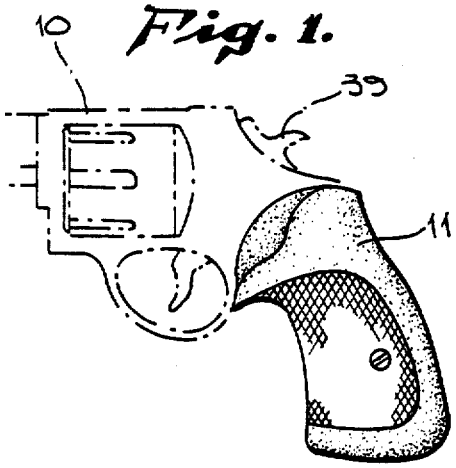
Fig. 4.
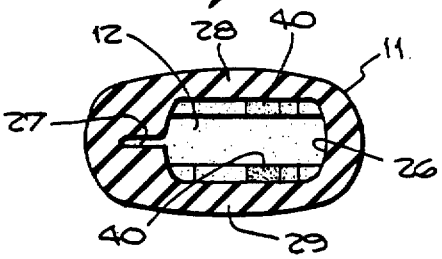
Fig. 2.
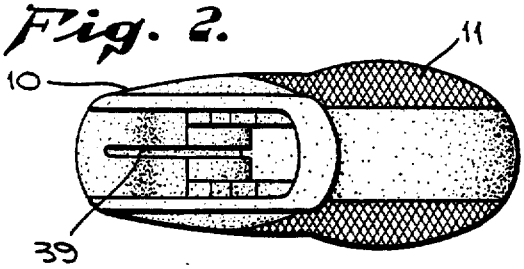
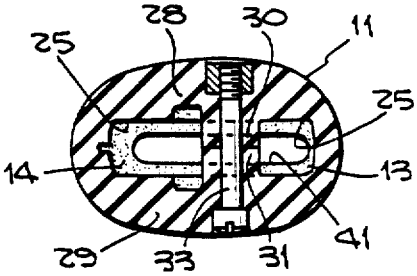
Fig. 5.
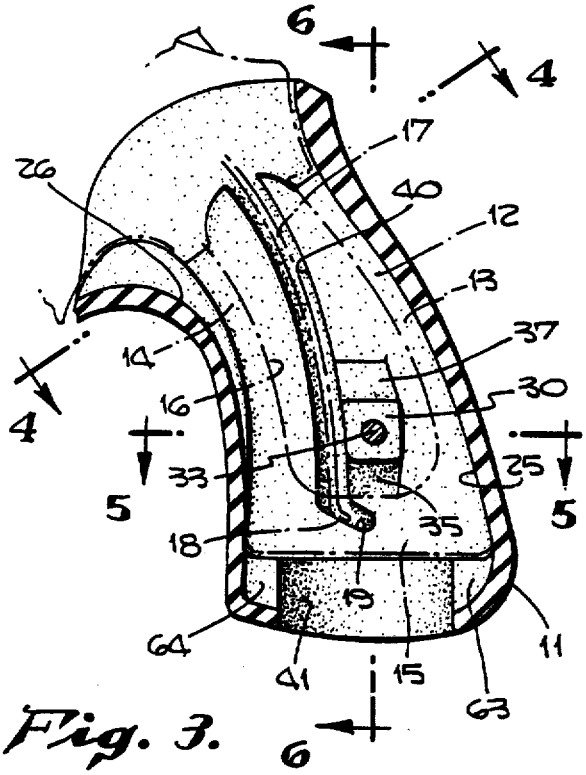
Fig. 3.
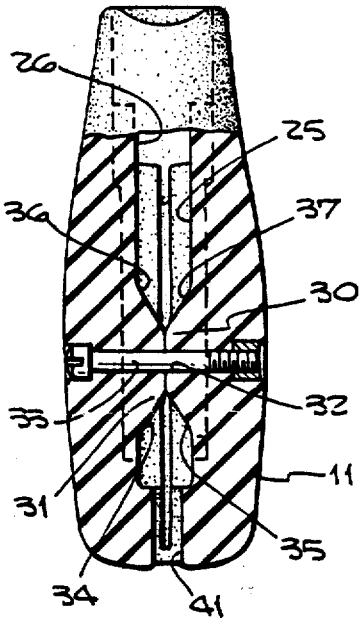
Fig. 6.

Fig. 8.
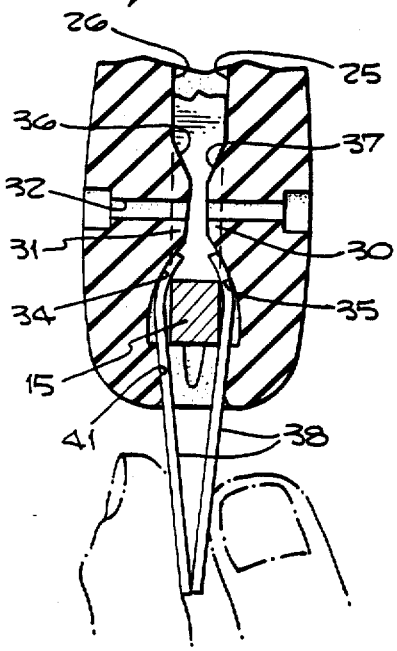
Fig. 7.
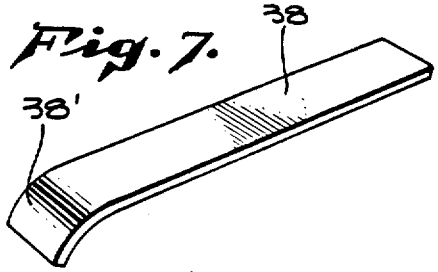
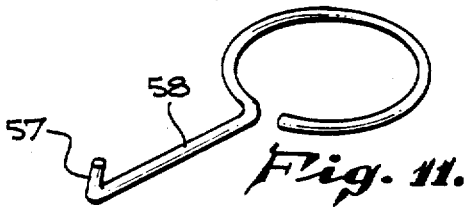
Fig. 11.
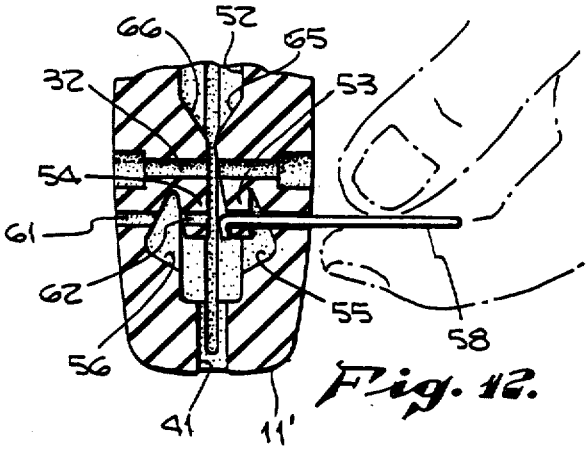
Fig. 12.
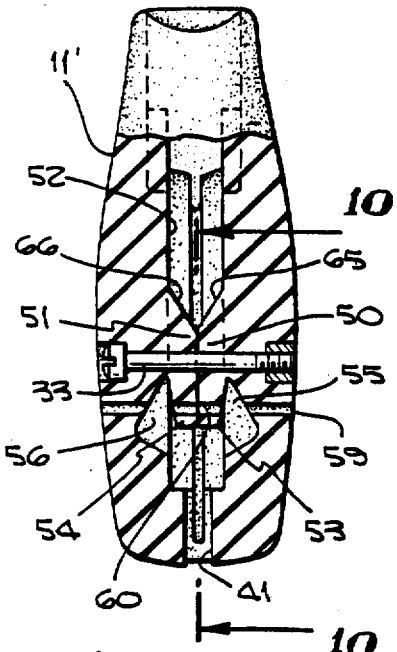
Fig. 9.
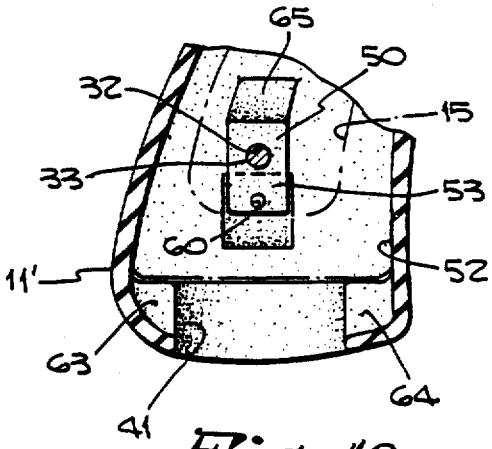
Fig. 10.

GRIP FOR HAND GUN

BACKGROUND OF THE INVENTION

The predominant practice heretofore in supplying grips for handguns, whether they be pistols or automatic weapons, has been that of two substantially equivalent halves of a grip which are fastened to opposite sides of the handle frame. This has been true whether or not the grip halves may be fastened to opposite sides of the frame while leaving the perimeter wall of the frame exposed, or whether the grip halves when installed completely encompass the frame. Although virtually any type or variety of grip can be devised in accordance with this structural approach having two entirely separate grip halves has presented problems not only in initial installation of the grip, but in subsequent removal and replacement. Such problems have remained whether or not the grip material chosen be a wood material or snythetic material of equal hardness, or a resilient moldable elastomeric material.

It is therefore among the objects of the invention to provide a new and improved grip for a hand gun wherein the grip itself is an integral material, elastomeric to a degree, and molded initially with a pocket for reception of the handle frame when the grip is applied to the hand gun.

Another object of the invention is to provide a new and improved grip for a hand gun which comprises a single mass of molded elastomeric material provided with a pocket for reception of the handle frame of such character that the grip can be readily applied to the frame, but wherein once applied it is secure in position against inadvertent removal.

Another object of the invention is to provide a new and improved molded single piece grip for a hand gun where a pocket is formed in the grip for reception of the handle frame, the pocket being specially formed so as not to impair dependable action of the hammer spring.

Still another object of the invention is to provide a new and improved grip for a hand gun consisting of a single molded mass with an appropriate pocket for the handle frame wherein there is a separable reinforcement mass within the pocket area capable of being spread during insertion and removal of the frame into the pocket, but which, once the frame has been inserted, prevents depression of opposite sides of the grip in the area of the pocket, thereby assuring a firm solid mass when the grip is in use.

With these and other objects in view, the invention consists of the construction arrangement and combination of the various parts of the device serving as examples of embodiments of the invention whereby the objects contemplated are attained, as hereinafter disclosed in the specification and drawings, and pointed out in the appended claims.

BRIEF DESCRIPTION OF THE DRAWINGS

FIG. 1 is a side elevational view of one form of the device shown attached to the handle of a pistol as representing a hand gun.

FIG. 2 is a plan view of the device as shown in FIG. 1.

FIG. 3 is a longitudinal sectional view of the device showing portions of the handle frame of the hand gun in phantom lines.

FIG. 4 is a cross-sectional view in the line 4–4 of FIG. 3.

FIG. 5 is a cross-sectional view in the line 5–5 of FIG. 3.

FIG. 6 is a longitudinal sectional view on line 6–6 of FIG. 3.

FIG. 7 is a perspective view of a tool for use with the device.

FIG. 8 is a cross-sectional view in the same area as FIG. 6 showing use of the tool of FIG. 7.

FIG. 9 is a longitudinal sectional view of a modified form of the device.

FIG. 10 is a fragmentary sectional view on the line 10—10 of FIG. 9.

FIG. 11 is a perspective view of a tool usable with the device of FIG. 9.

FIG. 12 is a fragmentary sectional view showing a portion of FIG. 9 and with the tool of FIG. 11 being made use of.

In an embodiment of the invention chosen for the purpose of illustration, there is shown a substantially conventional pistol 10 wherein a grip 11 comprising the invention has been applied to the handle. In keeping with conventional practice, the handle of the pistol is provided with a frame 12 frequently referred to as a tang, the frame having opposite relatively long side members 13 and 14, and an end member 15, leaving an open inside space 16.

Also, in keeping with conventional practice, a hammer spring 17 extends through the space 16 with its free end 18 lodged in a recess 19 of the end member 15. The grip 11 is adapted to entirely surround the frame 2, as depicted in FIGS. 1, 2 and 3.

To accommodate the frame 12 the grip 11 is provided with a pocket 25, the perimetrical wall portion of which matches to a substantial degree the perimetrical portion of the frame. For access to the pocket there is a passage 26 which, in the chosen embodiment, is slightly wider than a corresponding portion of the frame 12, but somewhat smaller than the breadth of the end member 15 of the frame. In order for the passage 26 to spread sufficiently to permit insertion of the end member 15 of the frame, there is a slot 27, sides of which can be spread apart during the insertion by reason of the grip being made of a mass of resilient elastomeric material. The pocket is further defined by side walls 28 and 29, inner faces of which are spaced apart a distance substantially equal to the thickness of the frame 12 and as identified by its side members 13 and 14.

In view of the fact that the recess 16 intermediate the side members 13 and 14 is relatively ample, there are provided plugs 30 and 31 of the same elastomeric mass of material of which the handle is made. The plugs 30 and 31 have respective depths such that they fill the space within the pocket between the side walls 28 and 29. Moreover, the space at the location of the plugs is within the recess 16 of the frame 12. Positioned as described, the plugs prevent depression at the sides of the grip even though the space 16 is relatively large. It is additionally of convenience to locate a hole 32 between opposite sides of the grip centrally relative to the plugs 30, 31 to accommodate a bolt 33 useful in fastening the grip in position once it has been applied to the frame.

To assist in spreading apart the plugs 30 and 31 when the grip is applied to the frame, beveled ends 36 and 37 are provided for the respective plugs 30 and 31. Contrarily when the grip is to be removed from the frame, beveled ends 34 and 35 of the plugs 30 and 31 are made use of.

As an additional expedient in spreading apart the plugs 30 ad 31, there is provided a slot 41 between the pocket 25 and the butt end of the grip 11, into which a pry 38 with a curved end 38' can be inserted, see FIG. 8. The pry is an accessory tool which can be inserted under special circumstances when the end member 15 of the frame 12 has a troublesome shape for spreading apart of the sides of the pocket while the end member 15 is being withdrawn past the plugs 30, 31.

In that the hammer spring 17 must be completely free to move at all times so as not to impair action of a hammer 39, grooves 40 are molded on the inside surfaces of the side walls 28, 29, the grooves extending to a degree along an axis of insertion of the frame into the pocket, as well as having an arcuate form comparable to the form of the hammer spring 17. The grooves 40 are made deep enough to provide ample clearance for the hammer spring.

To additionally improve retention of the grip 11 on the frame 12, plugs 50 and 51 may be made use of in a pocket 52 in a grip 11' of alternate construction. In this form of the device, projections 53 and 54 on the respective plugs 50 and 51 extend downwardly toward the butt of the grip as viewed in FIG. 9. For reception of the projections when they are spread apart, there are provided respective clearance recesses 55 and 56. When the grip 11' is applied to the frame 12, the end member 15 will occupy the space between ends of the projections 53, 54, and the lower end of the pocket 52. When the grip 11' is to be removed from the frame, a hook 57 at the end of a tool 58 is projected through a hole 59 at the side of the grip and through an inner hole 60 in the projection 53, see FIG. 12. Resilience of the elastomeric material of the grip is sufficient to allow the holes to expand sufficient to permit passage of the hook 57. Once inserted, the hook 57 can be moved a short distance left to right as viewed in FIG. 12 sufficient to have the end of the projection 53 clear the inside edge of the end member 15. If need be, a second identical hook member 58 may be inserted through holes 61 and 62 on the opposite side to pull the projection 54 outwardly into the clearance recess 56. To additionally improve the ease of spreading opposite sides of the pocket 52, end recesses 63 and 64 may be provided for the slot 41 in either the form of invention of FIG. 3 or of FIG. 9. It is further of interest to note that the plugs 50 and 51 are provided at their respective opposite ends with beveled ends 65 and 66 to facilitate application of the grip 11' to the frame 12.

While a particular embodiment of the present invention has been shown and described, it will be obvious to those skilled in the art that changes and modificaitons may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. A grip for a hand gun provided with a handle frame having an open mid-portion and a hammer spring, said grip comprising a substantially integral mass of yieldable elastomeric material having the form of a hand held grip on the exterior and having a pocket within the grip for reception of the handle frame, said pocket having a perimetrical wall adapted to extend around and into engagement with fore and aft and butt edges of said frame, said pocket having side walls intermediate the perimetrical wall adapted to enclose sides of said frame, said grip having a passageway between the pocket and the exterior of the grip at an end of said pocket opposite from the butt edge, said end of said pocket being expandable in response to insertion and removal of said frame along an insertion axis between opposite ends of the pocket and being retractable into engagement with said frame for retention of said grip on said frame.

2. A grip for a hand gun as in claim 1 wherein there is a releasable fastener extending transversely through the grip within the area of the pocket.

3. A grip for a hand gun provided with a handle frame having an open mid-portion and a hammer spring, said grip comprising a substantially integral mass of yieldable elastomeric material having the form of a hand held grip on the exterior and having a pocket within the grip for reception of the handle frame, said pocket having a perimetrical wall adapted to extend around fore and aft and butt edges of said frame and side walls adapted to enclose sides of said frame, said grip having a passageway between the pocket and the exterior of the grip at an end of said pocket opposite from the butt edge for insertion and removal of said frame along an insertion axis between opposite ends of the pocket, a secondary mass of said elastomeric material having a location within the perimeter of said pocket and adapted to occupy and substantially fill a portion of the pocket between opposite side walls and fastening means effective between opposite side walls at the location of said secondary mass.

4. A grip for a hand gun as in claim 3 wherein said secondary mass has obliquely beveled approaches in opposite axial directions and in axial alignment with said butt edge adapted to facilitate lateral expansion of side walls of the pocket during insertion and removal of said handle frame.

5. A grip for a hand gun as in claim 3 wherein said secondary mass comprises separate substantially equivalent contacting plugs integral with respectively opposite side walls.

6. A grip for a hand gun as in claim 5 wherein there is a slot between the pocket and the exterior of the butt end of the grip for reception of a pry to facilitate displacement of said plugs and related portions of the side walls in a lateral direction during application of said grip to the handle frame.

7. A grip for a hand gun provided with a handle frame having an open portion and a hammer spring, said grip comprising a substantially integral mass of elastomeric material having the form of a hand held grip on the exterior and having a pocket within the grip for reception of the handle frame, said pocket having a perimetrical wall adapted to extend around the edge of said frame and side walls adapted to enclose sides of said frame, said grip having a passageway between the pocket and the exterior of the grip for insertion and removal of said frame along an insertion axis between opposite ends of the pocket, a secondary mass of said elastomeric material having a location within the perimeter of said pocket and adapted to occupy and fill a portion of the pocket between opposite side walls, said secondary mass comprising separate substantially equivalent contacting plugs on respectively opposite side walls, projections on said plugs extending axially toward the butt of said grip end, a slot between the pocket and the butt end of the grip for reception of a pry, outwardly extending clearance recesses on inside faces of respective side walls of the pocket at the location of said projections during removal of said grip from the handle frame.

8. A grip for a hand gun as in claim 7 wherein there are transversely extending perforations through at least one of the projections and adjacent portion of the side wall of the grip for reception of a hook whereby to spread the position of the respective projection during removal of the grip from the handle frame.

9. A grip for a hand gun as in claim 8 wherein there are transversely extending perforations through both projections and adjacent portion of the side walls of the grip for reception of hooks on both sides.

10. A grip for a hand gun provided with a handle frame having an open mid-portion and a hammer spring, said grip comprising a substantially integral mass of yieldable elastomeric material having the form of a hand held grip on the exterior and having a pocket within the grip for reception of the handle frame, said pocket having a perimetrical wall adapted to extend around fore and aft and butt edges of said frame and side walls adapted to enclose sides of said frame, said grip having a passageway between the pocket and the exterior of the grip at an end of said pocket opposite from the butt edge for insertion and removal of said frame along an insertion axis between opposite ends of the pocket, and a releasable fastener extending between opposite sides of the grip and through said secondary mass for securing the grip to the frame.

11. A grip for a hand gun as in claim wherein there are elongated grooves on inside faces of said side walls substantially coincident with the location of the hammer spring for added clearance of opposite sides of said hammer spring.

* * * * *

UNITED STATES PATENT AND TRADEMARK OFFICE

CERTIFICATE OF CORRECTION

PATENT NO. : 4,638,582

DATED : January 27, 1987

INVENTOR(S) : Frank W. Farrar

It is certified that error appears in the above-identified patent and that said Letters Patent is hereby corrected as shown below:

Column 6, line 13, claim 11, after " claim" insert -- 1 --.

Signed and Sealed this

Fifth Day of July, 1988

*Attest:*

*Attesting Officer*

DONALD J. QUIGG

*Commissioner of Patents and Trademarks*